United States Patent [19]

Gipson

[11] 3,941,711

[45] Mar. 2, 1976

[54] NOVEL COMBINATION SOAP BAR

[75] Inventor: Robert Malone Gipson, Austin, Tex.

[73] Assignee: Jefferson Chemical Company, Inc., Houston, Tex.

[22] Filed: Jan. 24, 1974

[21] Appl. No.: 436,026

[52] U.S. Cl. ..... 252/117; 252/132; 252/134; 252/545; 252/DIG. 5; 252/DIG. 16

[51] Int. Cl.[2]. C11D 1/28; C11D 9/32; C11D 10/04; C11D 17/00

[58] Field of Search ..... 252/110, 117, 121, 134, 252/174, 526, 545, DIG. 5, DIG. 13, DIG. 16

[56] References Cited

UNITED STATES PATENTS

| | | | |
|---|---|---|---|
| 3,247,121 | 4/1966 | Hendricks | 252/117 |
| 3,640,882 | 2/1972 | Groves | 252/121 |

FOREIGN PATENTS OR APPLICATIONS

| | | | |
|---|---|---|---|
| 1,107,441 | 3/1968 | United Kingdom | 252/526 |

OTHER PUBLICATIONS

J. K. Weil et al.,: "Sulfated Diglycolamides", *J. Am. Oil Chemists Soc. Vol.* 48, Jan. 1971, pp. 35–37.

*Primary Examiner*—Dennis L. Albrecht
*Attorney, Agent, or Firm*—James L. Bailey; John R. Kirk, Jr.; Lee G. Meyer

[57] ABSTRACT

A novel combination soap bar effective in hard water is disclosed which is comprised of a major amount of a fatty acid soap and a minor amount of an alkali metal, amine or ammonium salt of an N-2(2-hydroxyethoxy)ethyl fatty amide-H-sulfate containing about 12 to 18 carbons in the fatty amide chain. The inventive combination bar produces a stable lather when used in hard water, yet will not produce a scum or insoluble precipitates. The novel combination bar may also include other ingredients such as perfumes, deodorants, anti-microbial agents, emollients, and other surfactants and processing aids, such as fatty acids, starch, polyethylene glycol, and the like.

5 Claims, No Drawings

NOVEL COMBINATION SOAP BAR

BACKGROUND OF THE INVENTION

This invention relates to the detergent art and more particularly pertains to soap-based toilet bars and their preparation which are useful in light duty cleaning applications, personal hygiene and the like.

DESCRIPTION OF THE PRIOR ART

There are many types of soap-based bars, usually referred to as toilet or bath bars, that have been prepared and marketed over the years for personal bathing, hand washing, and the cleaning of delicate articles such as delicate fabrics. Conventionally, toilet bars have been prepared from proprietary formulations of sodium and potassium soaps of higher fatty acids containing about 8 to 20 carbon atoms and other ingredients which improve the texture, appearance, and cleaning performance of bars. Some examples of other ingredients commonly employed include plasticizing agents, perfumes and/or deodorants, antimicrobial agents, inert inorganic fillers or builders and other surfactants. Conventional toilet soap bars are generally prepared from sodium and potassium soaps of fatty acid mixtures derived from natural fats and oils such as tallow, coconut oil, palm oil, palm kernel oil, soybean oil and the like. As is known in the detergent art, sodium fatty acid soaps are usually harder than potassium soaps and soaps of saturated fatty acids are harder than those prepared from unsaturated fatty acids. Accordingly, the hardness of fatty acid soaps increases with the length of the fatty chain. Most commercial toilet soap bars contain major amounts of sodium soaps of saturated fatty acid mixtures with minor amounts of potassium soaps and unsaturated fatty acid soaps to alter the feel, texture, appearance and wearability of the bar. In order to increase the hardness, many fatty acid soaps are prepared from natural fats and oils that have been hydrogenated by known processes.

However, toilet soap bars comprised primarily of fatty acid soaps have the disadvantage of producing scum when used for cleaning in hard water. The scum, generally comprised of insoluble alkaline earth or other multivalent metal soap (calcium, magnesium, etc.) precipitates, is not only unsightly and difficult to remove from the washing basin, but also interferes with cleaning effectiveness. Moreover, fatty acid soap bars swell and slough off when immersed in water for extended periods of time and tend to crack and fall apart when removed therefrom and allowed to dry.

Due to these disadvantages, there has been a trend in the industry to manufacture toilet bars from blends of sodium and/or potassium soaps and compounds classified in the art as synthetic detergents or surfactants. There are also many commercially available bars prepared from these synthetic detergent compounds entirely devoid of the traditional fatty acid soaps. An extensive literature exists on synthetic detergents or surfactants and their use in toilet bar formulations, for example: U.S. Pat. Nos. 2,894,912; 2,781,320; 3,154,494; 3,186,948; 3,223,645; 3,224,976; 3,226,330; and others to point out a few. The specific compositions of many synthetic detergent and soap-synthetic detergent bars, usually referred to as combination bars in the industry, vary greatly, the majority of formulations being proprietary to the particular manufacturer.

Although many of the recent prior art combination bars are improvements over conventional fatty acid soap bars, there has been a tremendous amount of activity in the detergent industry to produce toilet bars having improved appearance, texture, feel and wearability acceptable to all consumers and that will perform satisfactorily under practically all working conditions. It is believed that the novel combination soap bar of the present invention does just that inasmuch as the product of this invention is a surprising improvement over the prior art combination bars.

Accordingly, it is an object of the invention to present a novel combination soap bar that exhibits effective cleansing action in the presence of hard water for personal hygiene, washing of delicate articles, and the like.

It is another object of the invention to provide a novel combination soap bar that produces a stable lather with no scum formation in the presence of hard water.

It is another object of the present invention to provide a combination soap bar that exhibits many of the more desirable properties of soap bars such as good feel, good lathering properties, a pleasing lustrous appearance, a moderate rate of wear, little tendency to swell or slough off in the presence of water or to crack in the absence of water, and It is yet another object of the present invention to provide a combination soap bar that can include other ingredients such as perfumes, deodorants, emollients, other surfactants and appearance and processing aids without reducing the cleansing effectiveness thereof.

Other objects and advantages, if not set forth specifically herein, will become readily apparent from the ensuing description.

SUMMARY OF THE INVENTION

Generally, the present invention is a novel toilet combination soap bar effective in hard water that produces a stable lather and is substantially resistant to scum formation which is comprised of an intimate admixture of a major amount of a fatty acid soap of sodium, potassium or mixtures thereof and a minor amount of an alkali metal, amine or ammonium salt of an N-2(2-hydroxyethoxy)ethyl fatty amide-H-sulfate that contains about 10 to 18 carbons in the fatty amide chain. The inventive combination bars do not swell, smear or slough off when left standing in water for extended periods of time and dry rapidly to their original textures without cracking. Moreover, the bars have good feel, a pleasing lustrous appearance and exhibit excellent cleaning ability in tap water of practically any hardness.

DESCRIPTION OF THE PREFERRED EMBODIMENTS

The alkali metal, amine or ammonium salts of N-2(2-hydroxyethoxy)ethyl fatty amide-H-sulfates of the inventive combination soap bars are known compounds and have been employed as surfactants or dispersants in heavy-duty synthetic detergent and liquid shampoo formulations. However, heretofore, these specific sulfated amide compounds have not been found to be useful in the preparation of combination toilet bars.

The fatty amide sulfate salts of the invention are generally prepared in a known manner by mixing and reacting 2(2-aminoethoxy)ethanol with a fatty acid compound, followed by sulfation of the reaction product with sulfur trioxide, chlorosulfonic acid, sulfamic acid, or sulfuric acid. More particularly, the fatty acid compounds are fatty acids containing about 12 to about 18 carbon atoms per molecule, their esters and glycerides, and mixtures thereof.

Preferably, the inventive combination soap bars contain minor amounts of sodium or potassium salts of N-2(2-hydroxyethoxy)ethyl fatty amide-H-sulfates derived from lauric, palmitic, myristic, stearic, or oleic acids, or naturally occurring mixtures thereof such as those found in palm oil, soybean oil, tallow or the hydrogenated fatty acids from the same sources. Examples of the preferred fatty amide sulfate salts are sodium N-2(2-hydroxyethoxy)ethyl tallow amide-H-sulfate, sodium N-2(2-hydroxyethoxy)ethyl palm amide-H-sulfate, sodium N-2(2-hydroxyethoxy)ethyl (hydrogenated) tallow amide-H-sulfate, sodium or potassium N-2(2-hydroxyethoxy)ethylstearamide-H-sulfate, ammonium N-2(2-hydroxyethyoxy)ethyloleamide-H-sulfate, triethanolamine salt of N-2-(2-hydroxyethoxy)ethylmyristamide-H-sulfate, sodium or potassium N-2(2-hydroxyethyoxy)ethylpalmitamide-H-sulfate and the like or mixtures thereof.

The sodium and/or potassium fatty acid soap employed in the inventive combination soap bar may be any conventional soap of fatty acids derived from naturally occurring fats and oils, such as the sodium or potassium soaps of tallow, palm, soybean, or coconut fatty acids, their mixtures or their hydrogenated counterparts. Since potassium soaps are usually softer than sodium soaps, as mentioned hereinbefore, it is preferred that the fatty acid soap employed in the inventive bars be a sodium soap or that the fatty acid soap component contain at least 80% of sodium fatty acid soap, by weight of the fatty acid soap. Moreover, optimum results have been obtained by employing sodium soap mixtures of coconut and tallow. Sodium tallow soaps are generally hard, while sodium coconut soaps are quite soft. Intimate admixtures thereof in ratios, for example, between about 90:10 to about 70:30 tallow:-coconut soaps, by weight, are especially preferred.

More particularly, the novel combination soap toilet bars of the present invention contain in intimate admixture about 75% to 90% of fatty acid soap and from about 10% to about 25% of the N-2(2-hydroxyethoxy)ethyl fatty amide-H-sulfate salt, based upon the weight of the combination. Test bars of such combinations have been found to produce very stable lathers in all types of hard water tested, yet no scum formation has been detected. The fatty amide sulfate salts, when employed in these amounts, effectively disperse any heavy metal insoluble soap precipitates as they are formed in hard water and enhance or do not adversely affect lathering stability of the fatty acid soaps.

Other materials and ingredients conventionally employed in the manufacture of toilet bars may be included in the combination bars of the present invention if desirable. For example, the bars can include other synthetic surfactants, plasticizing agents and processing aids such as water, fatty acids, polyethylene glycols, alkanol amides, non-ionic surfactants, and the like. Starch, inorganic salts, divided clays and other inert fillers can be used if desired. Moreover, the bars can include the usual toilet bar additives such as colorants, perfumes or deodorants, emollients, anti-microbial agents, etc. Preferably, these additional ingredients are used in effective amounts of their intended use, and can be added in combination, in amounts up to about 15% by weight of the combination bar without producing adverse effects.

The combination soap bars of the present invention have been found to have many of the more desirable properties of toilet or bath bars such as good feel, good lathering properties, a moderate rate of wear, little tendency to swell or smear in the presence of water or to crack in the absence of water. Moreover, the combination bars of the present invention are highly effective for cleansing in personal hygiene and the washing of delicate fabrics even while used in hard water.

The product of this invention may be prepared by conventional toilet bar manufacturing procedures utilizing conventional equipment. For example, the products are preferably prepared by dissolving fatty acid soaps and fatty amide sulfate salts in hot water to form an intimate admixture along with any other desired additional ingredients, drying the mixture to a paste-like consistency containing less than about 10% by weight moisture and forming bars by milling, plodding, and stamping in the conventional manner. Alternatively, the dissolved admixture may be dried to granules or flakes containing 0% to 10% moisture and additional ingredients such as plasticizers and processing aids can be added to the granules prior to bar formation.

The following examples are given for the purpose of illustration, and not by way of limitation.

EXAMPLE I 80 g. of fatty acid soap (an 80:20 ratio of sodium tallow-coconut soaps) and 20 g., of sodium N-2(2-hydroxyethoxy)ethyl tallow-amide-H-sulfate were mixed and dissolved in a minimum amount of hot water (70°–90°C.). The solution was evaporated to a paste-like consistency and molded into bars weighing about 25–50 g. Additional bars were prepared in the same manner from 90 g. of the 80:20 tallow coconut soap and 10 g. of the tallow amide sulfate. All of the resultant bars had pleasing appearances, i.e., no cracking, lathered readily in hard water (200 ppm as $CaCO_3$) with stable bubbles and did not form a scum in the hard water. After being used for hand washing, the bars dried readily with retention of their good appearance. Storing the bars partially immersed in water caused no undue sloughing or swelling. The bars were stored on a desk top exposed to the air for four months without noticeable drying or cracking.

EXAMPLE II

The following combination bars were prepared in accordance with the method set forth in Example I. The amounts of compounds are set forth in percent by weight:

Bar A

80% sodium tallow soap

20% sodium N-2(2-hydroxyethoxy)ethyl palm amide-H-sulfate

Bar B

80% sodium tallow soap

20% sodium N-2(2-hydroxyethoxy)ethyl (hydrogenated) tallow amide-H-sulfate

Bar C 80% sodium tallow soap

15% sodium N-2(2-hydroxyethoxy)ethyl tallow amide-H-sulfate

5% N-2(2-hydroxythoxy)ethyl tallow amide

Bar A had a pleasing appearance and feel. It lathered readily in hard water (150 ppm $CaCO_3$) and no soap scum was formed. It dried quickly after use with no change in appearance or feel. Bar B was good in appearance and feel but was slightly brittle. This bar also lathered readily in the hard water, formed no soap scum and dried quickly after use. Bar C exhibited the same good appearance and performance in hard water, but was slightly softer than Bars A or B. Bar C was slightly slower to dry after use, but returned to good feel and appearance after about four hours. All of Bars A, B and C retained their good appearance with no cracking after storage for one week on a bench top.

Obviously many modifications and variations of the invention as hereinbefore set forth may be made without departing from the spirit and scope thereof and, therefore, only such limitations should be imposed as are indicated in the appended claims.

I claim:

1. A combination soap bar effective in hard water that produces a stable lather and is substantially resistant to scum formation in the presence of hard water, said bar comprising:

about 80% by weight of a fatty acid soap of sodium, potassium or mixtures thereof wherein at least about 80% of said fatty acid soap is in the form of the sodium salt, and wherein at least 70% by weight of said fatty acid soap is a tallow soap; and about 20% by weight of an alkali metal, amine or ammonium salt or mixtures thereof of an N-2(2-hydroxyethoxy)ethyl fatty amide-H-sulfate containing 12 to 18 carbon atoms in the fatty amide chain.

2. The combination soap bar of claim 1 wherein said N-2(2-hydroxyethoxy)ethyl fatty amide-H-sulfate salt is a sodium or potassium salt or mixtures thereof of a sulfated reaction product of 2-(2-aminoethoxy)ethanol and a fatty acid compound, said fatty acid compound being selected from the group consisting of fatty acids containing about 12 to 18 carbon atoms per molecule, and naturally occurring fats and oils containing mixtures of fatty acids having 12 to 18 carbons per fatty acid chain.

3. The combination soap bar of claim 2 wherein said fatty acids are selected from the group consisting of lauric acid, palmitic acid, myristic acid, stearic acid, oleic acid, and mixtures thereof.

4. The combination soap bar of claim 2 wherein the naturally occurring fats and oils are selected from the group consisting of palm oil, soybean oil, tallow, coconut, and mixtures thereof.

5. The combination soap bar of claim 4 wherein the N-2(2-hydroxyethoxy)ethyl fatty amide-H-sulfate salt is selected from the group consisting of sodium N-2(2-hydroxyethoxy)ethyl tallow amide-H-sulfate, sodium N-2(2-hydroxyethoxy)ethyl palm amide-H-sulfate, sodium N-2(2-hydroxyethoxyl)ethyl (hydrogenated) tallow amide-H-sulfate, and mixtures thereof.

* * * * *